US005232420A

United States Patent [19]

Terauds

[11] Patent Number: 5,232,420

[45] Date of Patent: Aug. 3, 1993

[54] PORTABLE STEEPING EXERCISE MACHINE

[76] Inventor: Juris Terauds, 1501 W. Lake St., Fort Collins, Colo. 80521

[21] Appl. No.: 917,418

[22] Filed: Jul. 23, 1992

[51] Int. Cl.[5] ..... A63B 22/04; A63B 23/08

[52] U.S. Cl. ..... 482/53; 482/79

[58] Field of Search ..... 482/51, 52, 53, 79, 482/80, 111, 112, 113

[56] References Cited

U.S. PATENT DOCUMENTS

| | | | |
|---|---|---|---|
| 4,838,543 | 6/1989 | Armstrong et al. | 482/112 |
| 4,946,162 | 8/1990 | Lubie | 482/80 |
| 5,004,224 | 4/1991 | Wang | 482/53 |

*Primary Examiner*—Stephen R. Crow

[57] ABSTRACT

An exercise machine is provided that includes two stepping platforms with pedal arms pivotally interconnected to a frame. The pedal arms are moved in a substantially vertical direction by the application of forces during the stepping motion by the user. The applied forces are resisted by fluidic cylinders physically connected such that the fluid can be forced through a resistance valve between the two cylinders, enabling an adjustment to the resistance to the movement of the pedal arms. A pair of cables attached to the pedal arms and the cylinder piston rods interconnects the pedal arm motion via fluid, passing through a resistance valve, between the connected cylinders. Preferably, the pair of lifter cables are adjustable or replaceable by another pair of lifter cables having different lengths.

18 Claims, 5 Drawing Sheets

PORTABLE STEEPING EXERCISE MACHINE

FIELD OF THE INVENTION

The present invention relates to exercising machines, in particular, to a portable stepping exercise machine having a cross hydraulic adjustable resistance system.

BACKGROUND OF THE INVENTION

Because labor saving devices have both substantially decreased the physical activity required by individuals and provided more recreational time, health-related exercise systems have been developed. These exercisers are intended to achieve or include at least some of the following benefits: (i) large skeletal muscle development such as leg muscles; (ii) variable resistance responsive to the strength of the user; (iii) adjustability such that both the amount of resistance and the range of motion can be tailored to substantially all users; (iv) training capability for strength, endurance and/or cardiovascular conditioning; (v) aerobic workout capability; (vi) compatibility with the mechanical movements of the human body; and (vii) durability, portability and relatively inexpensive to manufacture and assemble.

These worthwhile advantages are found to some extent in the following prior art stepping exercisers. In U.S. Pat. No. 3,295,847 issued to Matt, a portable stepping exerciser is disclosed that uses springs for resistance and is integral with its own carrying case. In disclosed that has a center pivot about which two foot pedals reciprocate in see-saw or rocking fashion. In U.S. Pat. No. 3,792,860 issued to Setnes, a stepping exerciser is disclosed that has a central inclined support between two foot platforms such that a crossbar pivots in see-saw fashion upon the end of the support projecting away from the floor. The crossbar is attached to the foot platforms such that the crossbar provides a mechanism for reciprocating the foot platforms. In U.S. Pat. No. 4,563,001 issued to the inventor of the exerciser disclosed herein, a stepping and arm exerciser is disclosed in which foot pedals reciprocate to each other and via the action of arm-manipulated levers.

Despite the large number of stepping exercise machines that have been proposed or devised, it would be worthwhile to provide a machine that incorporates more of the foregoing identified benefits in a single exercise machine.

SUMMARY OF THE INVENTION

The present invention relates to an exerciser for the legs that is suitable for physical fitness, rehabilitation, coordination, and athletic training and conditioning for cardiovascular or strength development. The stepping exerciser of the present invention is compact and lightweight so that it can be easily carried single-handedly or in a small suitcase.

The stepping exerciser includes first and second substantially parallel side-by-side foot pedals with pedal arms. Each pedal arm includes an elongated stepping surface adapted to receive the foot of the user. The pedal is part of a pedal arm having one end, the front, pivotally attached to the frame, while the other end, the back, designated foot placement. The pedal is further attached to the piston rod of the hydraulic or pneumatic resistance system by means of a lifter cable system, with the cable system pivotally attached in front of the foot platform of the pedal. The second pedal arm and pedal is symmetrical to the first pedal arm and its attachments.

The pedals with their foot platforms pivot in only a substantially vertical direction when the user applies forces thereto by means of a stepping action on the pedal. Thus, no lateral movement is required when using the exerciser. Each pedal arm is pivotally attached to said cable system which in turn is pivotally attached to the cable holder placed on the hydraulic pump piston rod, such that the piston rod is inserted in the cable holder cavity provided for that purpose. The hydraulic or pneumatic resistance cylinder system consisting of two interconnected pumps provides a smooth variable resistance to the downward motion applied to the pedal during the stepping motion of the user.

The stepping exerciser includes said lifter cable system for both pedals. The lifter cable system provides the force-exerting connection between the pedals and the hydraulic or pneumatic cylinder resistance system via the piston rods. That is, a downward force on a first pedal against the resistance of the first pump causes the fluid to flow through the resistance adjustment valve to the second pump which forces the piston and piston rod of the second pump to elevate, taking with it the lifter cable system and the second pedal pivotally attached to the second lifter cable system.

In connection with the transmission of motion, the piston rods connected to the pedal arms via the lifting cable system interact with each other by the transmission of fluid from the first hydraulic or pneumatic pump to the second pump. As the piston rod of the first pump is depressed the second pump's piston rod is proportionally extended and when the piston rod of the second pump is depressed the piston rod of the first pump is proportionally extended. By this movement, the substantially downward vertical movement of the pedals can be used to cause motion of the piston rods attached to the pedals via the lifting cable systems.

The portable stepping exerciser preferably includes a number of pairs of lifting cable systems, which may or may not be adjustable in length, with each pair having different lengths. By installing different height cable systems between the pedal arms and the ends of the piston rods of the pumps, or by adjusting the length of the cables, the range of the stepping motion can be varied or adjusted and, concomitantly, the work required to move or reciprocate the pedals can be changed.

The vertical range of pedal movement may also be adjusted by adding or removing fluid to said resistance system. The said fluid may be added or removed through the hollow piston rod by removing the piston rod cap. As fluid is added to said resistance system the maximum pedal height is elevated until the piston within the pump moves its full range. Conversely, the removal of fluid from said resistance system decreases the range of pedal movement.

The resistance to pedal movement can also be adjusted. In particular the interconnected hydraulic or pneumatic resistance cylinder system's resistance can be adjusted to meet the needs of the user by adjusting the valve. As the said valve is adjusted toward closing, the passage of fluid from the first pump to the second pump of the resistance system is restricted and with it the resistance to move the pedal being depressed, is increased. Conversely, as the said valve is adjusted toward opening, the passage of fluid from the second to the first pump of the resistance system is facilitated and with it the resistance of, to move the pedal being depressed, is decreased.

The resistance to be overcome during the stepping motion is also varied using the positions of the user's feet on the pedals. The closer the user's feet are positioned to the front of the pedals the more resistance is encountered. Conversely, the further the feet are located toward the back of the pedals, the less resistance is encountered.

As work by a user on the said stepping machine is performed heat is generated and the temperature of said resistance system is elevated. To counter excessive heat buildup said resistance system is provided with a relatively large surface base to dissipate heat by conduction, convection, and radiation.

To insure the smooth and lasting operation of said resistance system the hydraulic or pneumatic pumps mounted on said base of said resistance system are equipped with pistons having both bushings and seals. Made of low friction material, said bushings keep said pistons centered in the pump cylinder even though the force applied to said piston rod end by the cable system is off center and creates considerable torque about the short axis of the piston rod. The seals on said pistons are of low friction material capable of function at high temperatures. Said seals are designed not to leak fluid from or into the closed resistance system. Further, self lubricating low friction bushings at the piston rod exit from the cylinders counter said torque placed on the piston rods by said cable system activated by the downward movement of the pedals.

For convenience, the stepping machine is designed so it can be folded quickly for storage or transport. The working position of said stepping machine has the resistance system positioned on the horizontal frame with the long axis of the pumps and piston rods perpendicular to said frame in the position provided. With said resistance in position as described above, said cable system is connected to said piston rods by sliding the upper cable holders over the ends of said piston rods. Once said resistance system is on said frame and said cable holders are on said piston rods, the stepping machine is operational.

To fold said stepping machine for storage or transport said cable holders are lifted from said piston rods and said resistance system moved from its perpendicular position on said frame to its resting position parallel to said frame in the space provided for said resistance system at the back of said frame.

Based on the foregoing summary, a number of salient features of the present invention are readily discerned. A portable and compact stepping exercise machine is provided for easy use, storage and carrying. The machine is characterized by a relatively few number of parts. In that regard, the exerciser includes relatively short lifter cables for providing the interconnection between stepping members and a cross hydraulic or pneumatic pump resistance system. Preferably, a number of pairs of lifter cables, or adjustable lifter elements, are provided for use in varying the range of the stepping motion to supplement said pedal range change possible by adjusting the level of the fluid in said resistance system. Such lifter cables, together with the adjustment valve and the positioning of the user's feet on the platforms, enable the user to vary the resistance experienced during the stepping exercise.

Additional advantages of the present invention will become readily apparent from the following discussion, particularly when taken together with the accompanying drawings.

DETAILED DESCRIPTION

Figure 1:
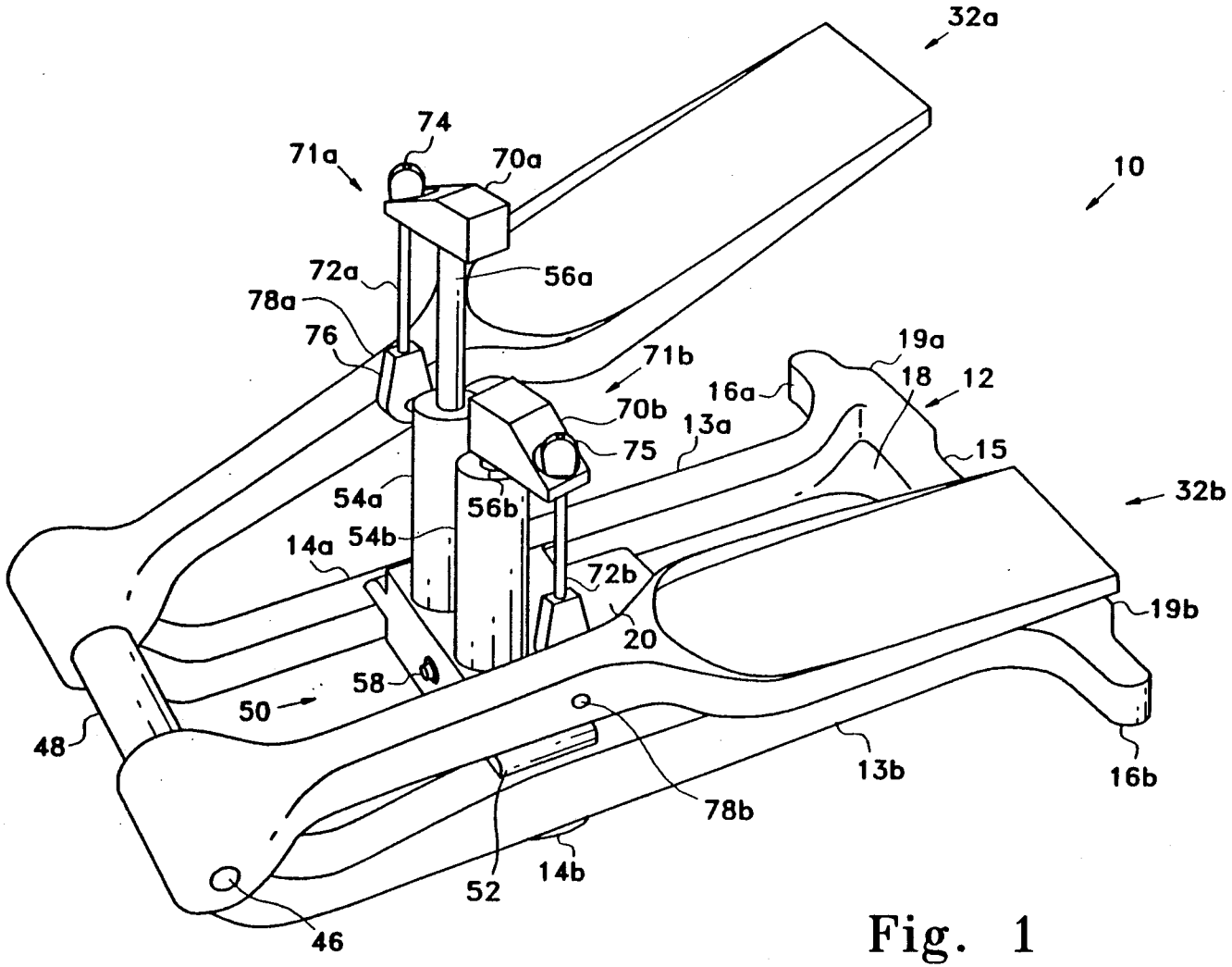
FIG. 1 is a perspective view of the portable stepping exercise machine of the present invention.
Figure 3:
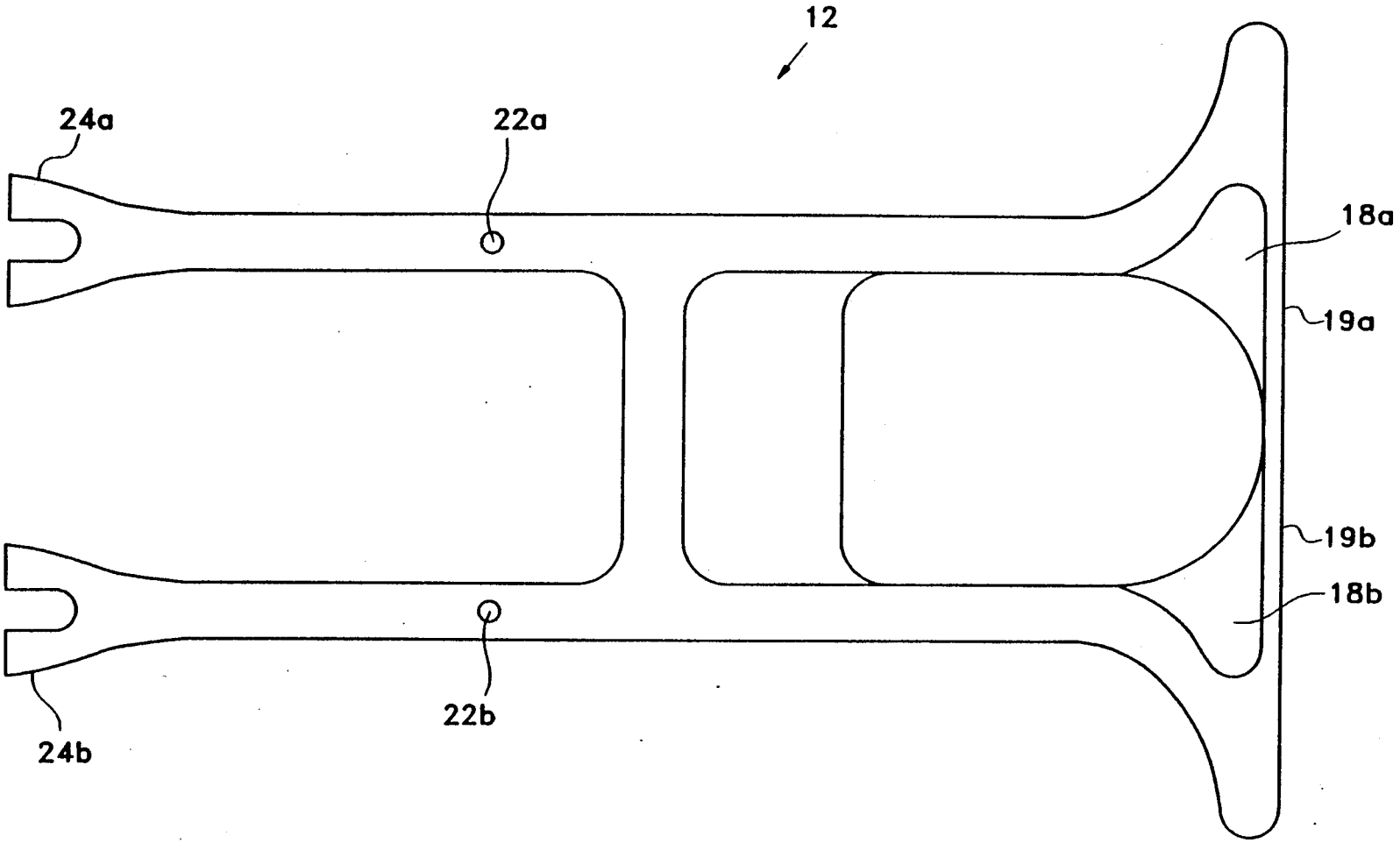
FIG. 3 is a top plan view of the portable stepping exercise machine frame.

With reference to FIG. 1, a portable stepping exerciser 10 is illustrated. The exerciser 10 includes a support frame 12 having two parallel lengthwise supports 13*a*, 13*b* which are on or near the floor elevated by supports 14*a* and 14*b*, and a rear cross-member support 15 at ends of 13*a*, 13*b* elevated by supports 16*a*, 16*b* such that 13, 15 provide sufficient longitudinal and lateral stability for the exerciser 10 to remain upright during use. The frame support 12 also includes a cylinder resting area (on both sides) 18 and a cylinder piston rod resting area 20 (FIG. 3).

Figure 2:
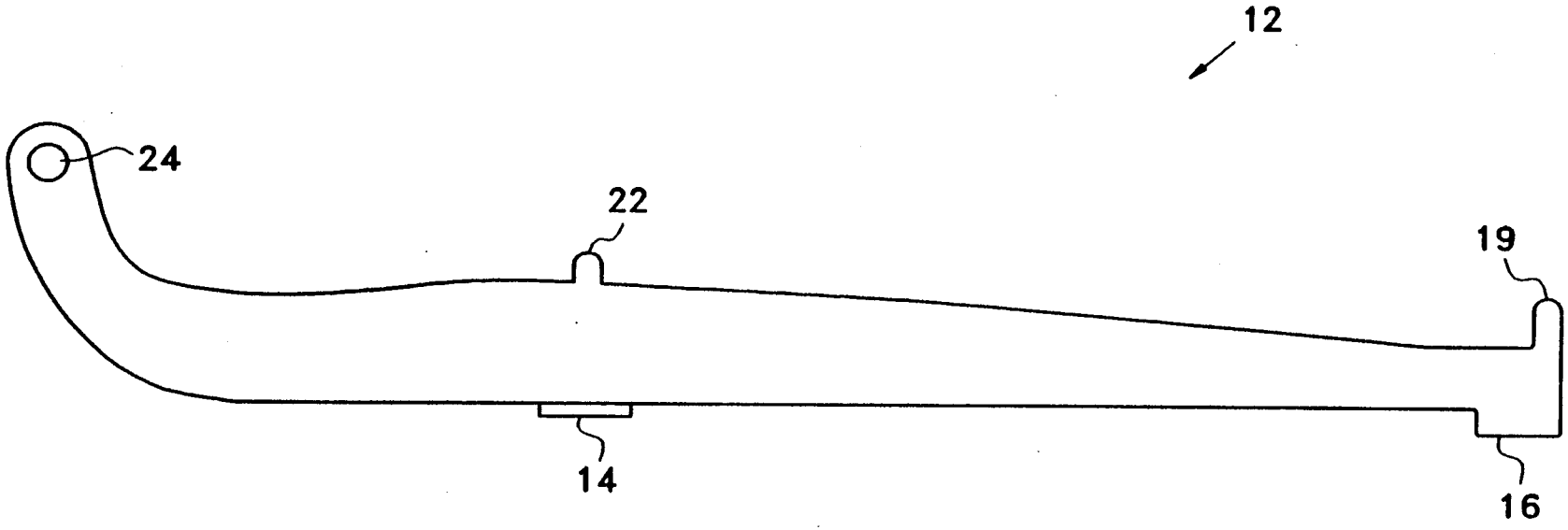
FIG. 2 is a side plan view of the portable stepping exercise machine frame.

For the stepper storage or transport, a pedal rest 19*a*, 19*b*, to stop or rest the pedals 32*a*, 32*b* in their most downward position, is provided. Also provided are anchor knobs or holes 22*a*, 22*b* to anchor the cylinder system 50, and axle holes 24*a*, 24*b* (FIG. 2) for pivotally attaching pedals 32*a*, 32*b* to the support frame 12 by axle means 46, passed through holes 24 at the front end of said frame 12 (FIG. 2).

Above the support frame 12 are two pedal arms with pedals 32*a*, 32*b* upon which a user steps when using the exerciser 10. The top side of each stepping pedal is provided with a relatively rough pattern to provide a non-slip surface. The front end of each pedal arm 32 is attached at right angles to a front horizontally extended cross-member or axle 46 at the front of the frame 12. The cross-member or axle 46 is attached to the frame 13. By this connection, the pedals 32 can pivot relative to the front cross-member or axle 46 in two vertically spaced apart parallel planes.

For each pedal 32*a*, 32*b* there is also a lifter cable system 71*a*, 72*b* attached thereto by pivotal means at 78*a*, 78*b* and at the upper end of the cable system 71*a*, 71*b* attached to the piston rods 56*a*, 56*b* of the hydraulic or pneumatic pumps 54*a*, 54*b*. Pumps 54 provide the desired resistance during the compression via the piston rods 56 which are regulated by the setting of the resistance adjustment valve 58. Moreover, the resistance force encountered upon compression of a pump 54 is smooth and varies with the adjustment of the resistance adjustment valve 58 and the compression force applied by the user.

Thus, any downward force applied to a pedal 32 will be met with a directly related opposing resistance force resulting from the compression of the pump 56 connected via cable system 71 to the piston rod 56.

Figure 4A:
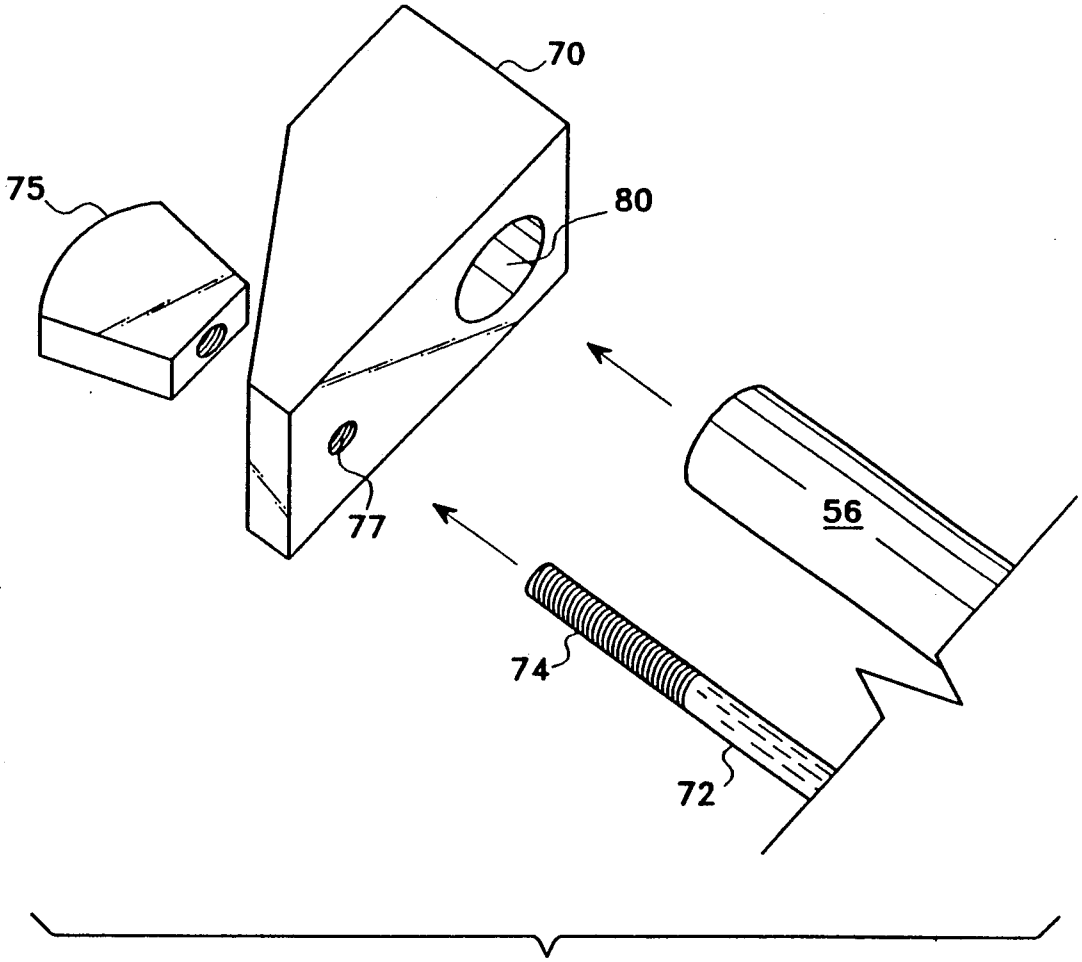
FIG. 4A is a perspective view of the upper cable holder.
Figure 4:
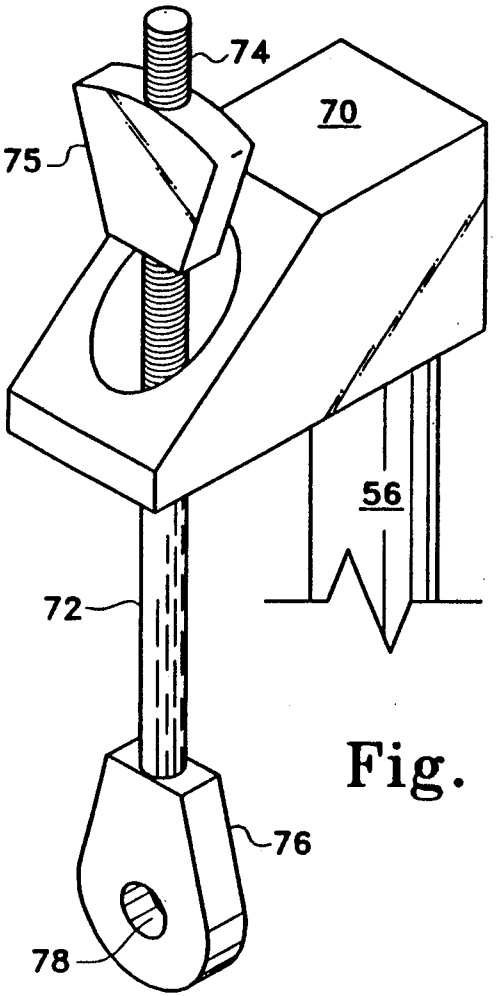
FIG. 4 is a perspective view of the cable system.

In order to coordinate the alternating raising and lowering of the pedals 32 a cable system 71 is provided. As illustrated in FIG. 4 and FIG. 4A the cable assembly 72 includes lower cable holders 76, with hole 78 to house bearing for pivotal attachment to said pedals 32, and adjustable upper cable retainers 75 (FIG. 4A), passed through cable hole 77 (FIG. 4A) of upper cable holders 70, with a piston rod retainer cavity 80 (FIG. 4A), which are pivotally attached to the pedals 32 and the piston rods 56 (FIG. 4A). A downward force on a raised pedal 32 (e.g. 32*a*, FIG. 1) is communicated, via cable system 71*a*, to piston rod 56*a*, to the pump 54*a* of the cylinder system 50, such that the liquid from pump 54*a* is forced through resistance adjustment valve 58 into pump 54*b*. The forced entrance of liquid from pump 54*a* forces the piston with the piston rod 56*b* of pump 54*b* to elevate and with it elevate said cable system 71*b* attached to pedal 32*b*, causing pedal 32*b* to raised proportionally.

In using the stepping exerciser 10, the user places the exerciser 10 on a generally level floor and determines the range and magnitude of resistive motion desired. The greater the range of motion, the greater the differential between a fully raised and fully lowered pedal 32. To vary the stepping motion differential, a plurality of varying length cable system 71 pairs are preferably used as part of the exerciser 10, or the active length of cable system 71 pairs may be adjusted with cable retainers 75 on the upper encased and threaded cable ends 74 (FIG. 4). Adjusting the cable retainers away from the lower cable holders 76, decreases pedal 32 height and range, or conversely adjusting the cable retainers 75 toward the lower cable holders 76, increases pedal height and range. The stepping motion differential can be increased by using shorter cable systems 71 since the pedal 32 to which it is operably connected is able to move in a greater up/down or vertical path. Conversely increased cable system 71 length decreases the range of pedal movement.

Once the desired length of cables 72 has been selected by the user, the chosen cable systems 71 (e.g. 70, 72, 74, 75, 67, FIG. 4) can be operationally attached to the pedals 32 and the piston rods 54. After selected cable systems 71 have been attached and/or adjusted in length the user may then position himself/herself on the pedals 32 while facing the front of the exerciser 10. Subsequently, the user shifts his/her weight alternatingly from one leg to the other in a stepping motion. When the downward force differential between a pedal 32 is sufficiently greater than the resistance of the connected pump 54 such that the friction of the various moving parts (including the liquid within the cylinder system 50 and the other pump 54) is overcome, the pedal 32*a* or 32*b* will be lowered and the other pedal 32*a* or 32*b* will be elevated.

The range of said pedal 32 movement may also be adjusted by increasing or decreasing the quantity of fluid in the hydraulic or pneumatic cylinder resistance system 50 (FIG. 1 and FIG. 5) via the hollow piston rods 56 when the piston rod cap 60 is removed. After adding or removing some fluid to the resistance system 50 through said hollow piston rod 56 said piston rod cap 60 is replaced making the resistance system 50 functional.

To increase the resistance of pedals 32*a* and 32*b* the valve 58, of said hydraulic or pneumatic resistance system 50, is adjusted toward closing. Conversely, to decrease the resistance of pedals 32*a* and 32*b* the valve 58 of the hydraulic pneumatic resistance system 50 is adjusted toward opening. This adjustment valve 58 is set to meet the desired needs of the user. The resistance of the pedals 32, to the user, may also be increased, with the potential range of motion decreased, when the user moves toward the front of the pedal 32, closer to the pedal's axis of rotation at 46, or the resistance to the user may also be decreased, with the potential range of motion increased, when the user moves toward the back of the pedal 32, further from the pedal's axis of rotation at 46.

As the pedals 32 reciprocate or move in a substantially vertical direction, each cable system 71 pivots on its associated connection with the pedal 32 and the piston rod, at the same time the piston rod 56 raises or lowers into the pump 54, rotating about its long axis just enough to meet the position of the cable system 71, attached to the piston rod 56. During this movement, the cable systems 71 tend to be somewhat off-set from vertical. By means of the pivoting and rotating motion of the cable system 71 and piston rod 56, a desired height or vertical range of motion of the pedals 32 can be achieved while providing the necessary smooth and non-binding connection between the pedals 32 and the pumps of the resistance system 50 providing the resistance.

Although the disclosed embodiment involves different pairs of cables that vary in length and/or are adjustable in length, it is not necessary that removable or adjustable cables be employed. The present invention could incorporate a fixed connection between the pedals 32 and piston rods 56 to achieve a predetermined range of motion. It should also be understood that the pedals 32 of the present invention need not be of a size to accommodate a certain range of different positions of the user's feet. Instead, a smaller or larger pedal could be employed which does not necessarily permit different positions of the user's feet, or which may increase possible positions for the feet.

To accommodate storage and transport by making the exerciser 10 more compact the hydraulic or pneumatic resistance system 50 may be removed from the working position on the frame and detached from the cables. The piston rods 56*a*, 56*b* are first brought to the same height by manipulating the position of the pedals 32*a*, 32*b*. Once the piston rods are at the same height, the hydraulic or pneumatic system 50 is detached from the cable systems 71 by lifting the upper cable holders 70 off the piston rods 56. With the cables detached from the piston rods 56, and the pedals 32 manually elevated, the vertically positioned hydraulic or pneumatic resistance system 50 is lifted from its male anchors 22*a*, 22*b* (FIG. 3) and placed horizontally, such that the base 52 of the system 50 is on the frame 12 in cavities 18*a*, 18*b* (FIG. 3), while the piston rods are on the frame resting on cross member 20. With the hydraulic or pneumatic resistance system 50 in its horizontal position on the frame 12, the pedals 32 are lowered and the exerciser 10 is ready for storage or transport.

Figure 5:
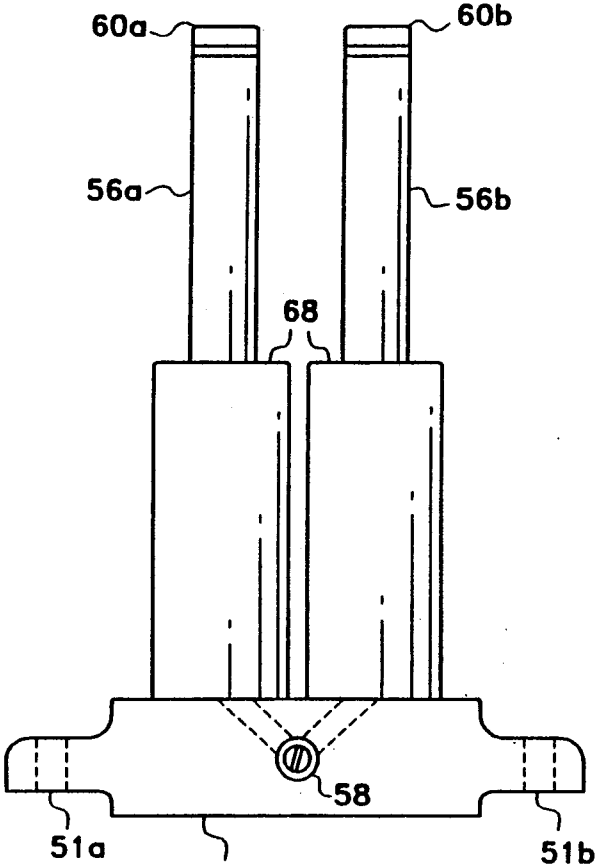
FIG. 5 is a front elevated plan view of the hydraulic or pneumatic cylinder resistance system.

To return the exerciser 10 from its storage/transport mode to its working position, the pedals 32*a*, 32*b* are sufficiently elevated by one hand while the other hand lifts the hydraulic or pneumatic resistance system 50 from its location on cavities 18*a*, 18*b* and positions it on its anchors 22*a*, 22*b* of the frame 12 (13*a*, 13*b*), such that the male anchors 22*a*, 22*b* fit directly in the cavities 51*a*, 51*b* provided in the base 52 of the hydraulic or pneumatic resistance system 50 (FIG. 5). It should be understood that the male anchor between the frame and hydraulic or pneumatic system of the present art may take other forms, for example, the male anchor could be on the base 52 of the hydraulic or pneumatic resistance system with the cavity to take that male anchor on the frame, or the hydraulic or pneumatic system could be permanently mounted on the frame or it could be part of the frame.

As exercise (work) is being done by the user on said exercise machine 10 heat is produced within the resistance system 50, which must be dissipated to prevent overheating. To dissipate said heat said resistance system 50 (FIG. 1, FIG. 5) is provided with a solid metal base 52 with a mass and surface area sufficient to accomplish said heat dissipation through conduction, convection and radiation.

Figure 6A:
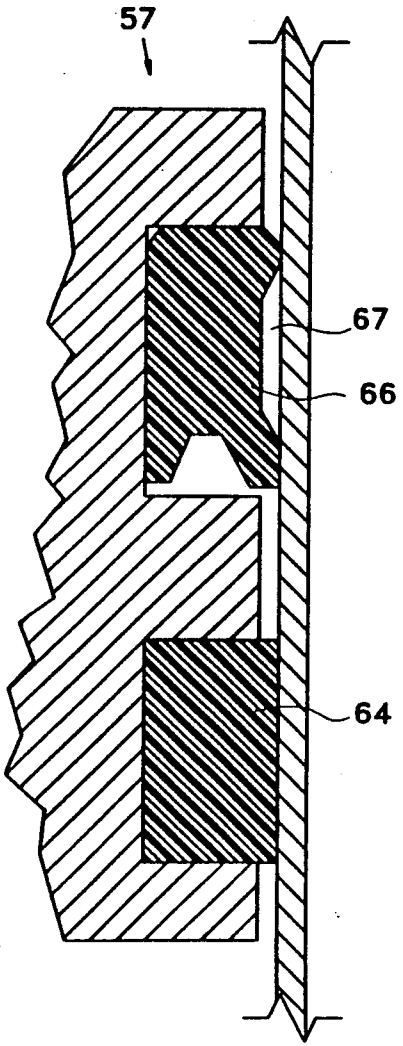
FIG. 6A is a cross section view of the fluid seal on the piston.
Figure 6:
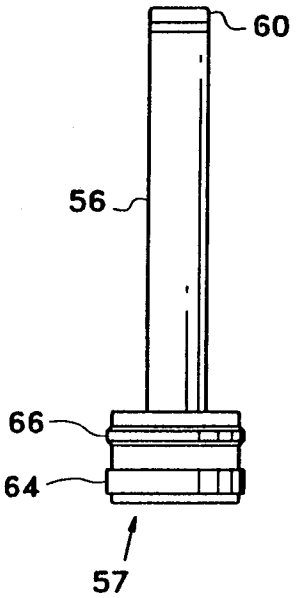
FIG. 6 is a side plan view of the piston rod with its piston.

Since the off center force on the piston rods 56 through the cable system 71 produces torque about the short axis of said piston rods, there is a significant side force exerted by the piston 57 on the inner wall of the cylinders of the pumps 54, with the potential of excessive friction. To decrease friction, wear and heat production, and to keep said piston 57 with said piston rod 56 centered, low friction bushings 64 are placed on said piston 57 and the piston rod guide 68. To provide said pump 54 operation without leaks of the fluid used, special low friction seals 66, with a particular surface shape 67 are utilized (FIG. 6 and FIG. 6A).

In view of the foregoing detailed description, a number of advantages of the present invention should be immediately recognized. A portable stepping exerciser is provided that allows the user to achieve desired exercise at a convenient time and location, including at home or at the user's work place or on trips. The exerciser is portable and lightweight for easy carrying and is compact to facilitate storage thereof. The exerciser has a reduced number of parts. The resistance and range of motion is preferably adjustable using a cross hydraulic or pneumatic resistance system with unique cable attachments. The pedals and the foot placement areas on the pedals for receiving the user's feet are preferably of a size to permit comfortable and safe use. The stepping exerciser is also relatively inexpensive, easy to manufacture and assemble and does not require lengthy of complicated interconnecting mechanisms.

The foregoing discussion of the invention has been presented for purposes of illustration and description. Further, the descriptions is not intended to limit the invention to the form disclosed herein. Subsequently, variation and modification commensurate with the above teachings, within the skill and knowledge of the relevant art, are within the scope of the present invention. The embodiment described hereinabove is further intended to explain the best mode presently known of practising the invention and to enable others skilled in the art to utilize the invention as such, or other embodiments, and with the various modifications required by their particular application or uses of the invention. It is intended that the appended claims be construed to include alternative embodiments to the extent permitted by the prior art.

What is claimed is:

1. A portable stepping exercise apparatus, comprising:

a pair of stepping means moving only in a substantially vertical direction upon application of force by the user of the apparatus;

cross hydraulic or pneumatic resistance system means having piston rods and cylinders connected to said stepping means;

frame means connected to said stepping means;

pedal means connected to said stepping means;

cable means connected to said stepping means, said cable means moving along a path somewhat different from the said stepping means; cable holder means comprising attachment means for connecting said cable means to said piston rods and to said stepping means.

2. An apparatus, as claimed in claim 1, wherein said interconnected cross hydraulic or pneumatic resistance system means is movable to a vertical working position.

3. An apparatus, as claimed in claim 1, wherein said interconnected cross hydraulic or pneumatic resistance system means is movable to a horizontal storage or carry position.

4. An apparatus, as claimed in claim 1, wherein said interconnected cross hydraulic or pneumatic resistance system means is designed to handle force loads with torques which are axially offset from the longitudinal axis of the piston rod.

5. An apparatus, as claimed in claim 1 wherein said interconnected cross hydraulic or pneumatic resistance system means is mounted on a single metal block which act as a heat dissipator.

6. An apparatus, as claimed in claim 1, wherein said interconnected cross hydraulic or pneumatic resistance system means, with internal fluid passages, includes an adjustment flow control valve.

7. An apparatus, as claimed in claim 1, wherein said frame means is connected to said stepping means by an axle means perpendicular to the stepping means.

8. An apparatus, as claimed in claim 1, wherein said cable means is adjustable in length.

9. An apparatus, as claimed in claim 1, wherein said cable means is provided in various lengths for stepping means height adjustment.

10. An apparatus, as claimed in claim 1, wherein said resistance means is easily removable and fits on said frame means in a position for easy storage or transport.

11. An apparatus, as claimed in claim 1, wherein said frame means houses the adjustment valve means.

12. An apparatus, as claimed in claim 1, wherein said piston rod has a low friction and heat resistant bushing for centering the piston and reducing fluid seal wear and damage.

13. An apparatus, as claimed in claim 1, wherein said piston rod has a low friction material, multiple lip, fluid seal designed to prevent leakage and give long wear.

14. An apparatus, as claimed in claim 1, wherein said valve means has a split stem such that the valve can be adjusted with a United States penny.

15. An apparatus, as claimed in claim 1, wherein said piston rod is a hollow round tube with the proximal end inserted in said piston and the distal (outer) end provided with a cap to make opening or closing of said tubular piston rod possible.

16. An apparatus, as claimed in claim 1, wherein said piston rod is provided with a centered hole to accomodate the tubular piston rod.

17. An apparatus, as claimed in claim 1, wherein said cable means has a threaded metal means is attached to an upper cable retainer means such that the cable means can be adjusted in length with the said upper cable retainer within the hole provided in the cable holder means.

18. An apparatus, as claimed in claim 1, wherein said cable holder means is provided with a cylindrical cavity means such that the piston rod means can be inserted in said cavity means.

* * * * *